US007317368B2

(12) United States Patent
Shimizu et al.

(10) Patent No.: US 7,317,368 B2
(45) Date of Patent: Jan. 8, 2008

(54) REED RELAY, REMOVABLE BUSHING THEREOF, AND REED RELAY MOUNTING METHOD THEREFOR

(75) Inventors: Hiroyuki Shimizu, Tokyo (JP); Yoshiyuki Bessho, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 272 days.

(21) Appl. No.: 11/058,758

(22) Filed: Feb. 16, 2005

(65) Prior Publication Data

US 2005/0190028 A1 Sep. 1, 2005

(30) Foreign Application Priority Data

Feb. 27, 2004 (JP) ..... 2004-054505

(51) Int. Cl.
*H01H 1/66* (2006.01)

(52) U.S. Cl. ..... 335/151

(58) Field of Classification Search ..... 335/151–154
See application file for complete search history.

(56) References Cited

U.S. PATENT DOCUMENTS 3,845,431 A * 10/1974 Bongard ..... 335/152
5,861,787 A * 1/1999 Graeber ..... 335/154
6,271,740 B1 8/2001 Chikamatsu ..... 335/151

FOREIGN PATENT DOCUMENTS

JP 59-71227 4/1984
JP 08-279314 10/1996

* cited by examiner

*Primary Examiner*—Ramon M. Barrera

(57) ABSTRACT

A reed relay which comprises a reed switch with reeds at both ends; an electrostatic shield pipe inside which the reed switch passes; a coil bobbin having a hollow part in which the electrostatic shield pipe is disposed; removable bushings attached to the electrostatic shield pipe and the coil bobbin and having a reed support hole that supports the reed switch; and the removable bushing is capable of disabling the support of the reed switch by the bushings after anchoring the reed relay and both ends of the reeds.

14 Claims, 11 Drawing Sheets

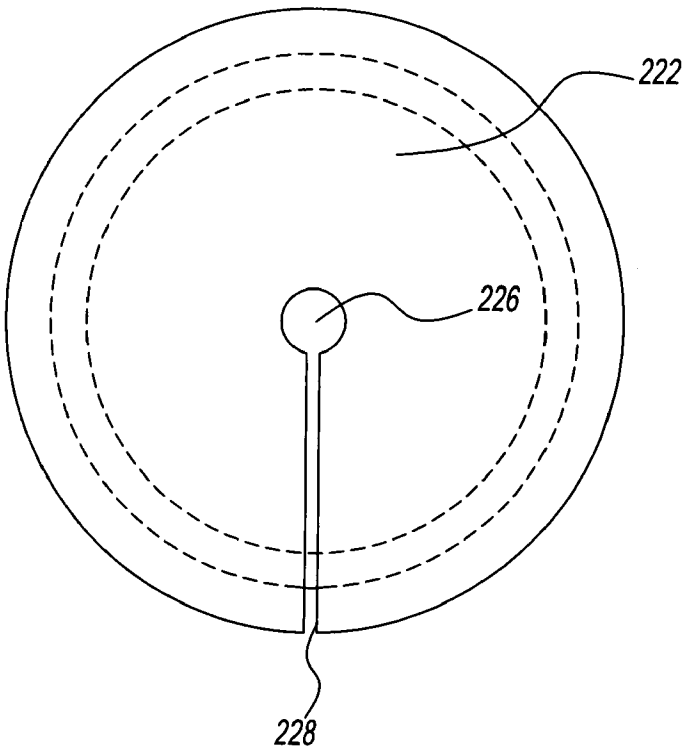
Fig. 9
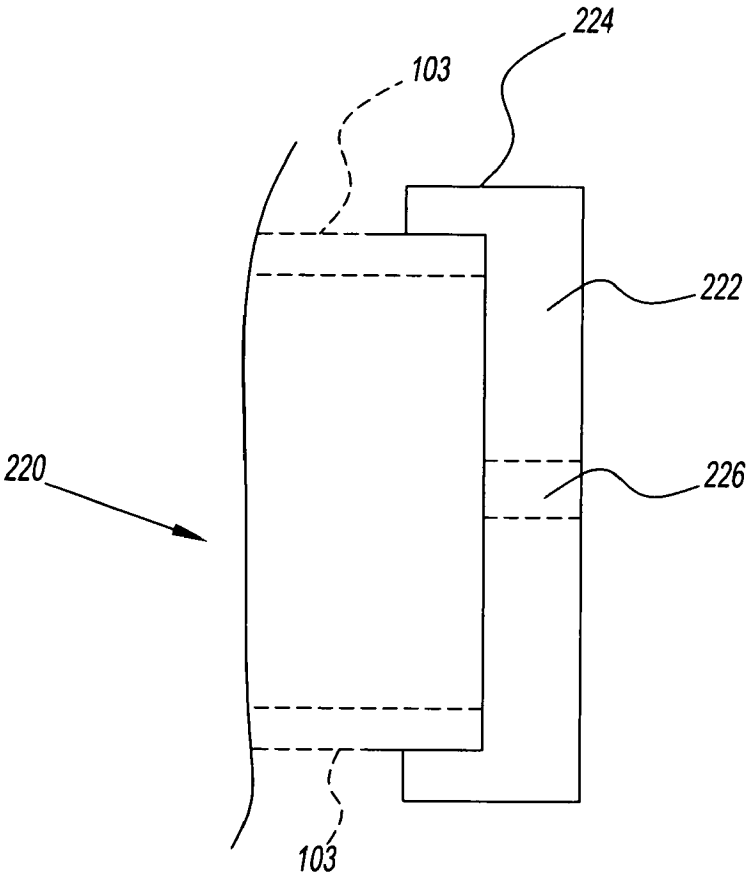

(A)

(B)

REED RELAY, REMOVABLE BUSHING THEREOF, AND REED RELAY MOUNTING METHOD THEREFOR

FIELD OF THE INVENTION

The present invention relates to a reed relay for microsignals and a mounting method therefor.

DISCUSSION OF THE BACKGROUND ART

It is necessary to use low-leak, high-insulation relays for the relays on the signal paths in microsignal measurement. The reed relay according to JP Laid-Open (Kokai) Patent 2001-14,994, FIG. 5, is known as this type of relay and is shown in FIG. 7 as reed relay 500. A reed switch 501 is supported inside an electrostatic shield pipe 503 by bushings 502*a* and 502*b* made from a high insulator, and this electrostatic shield pipe 503 is disposed in the cylindrical hollow part of a coil bobbin 504. A space 509 is formed between the inside wall of coil bobbin 504 and the outside wall of electrostatic shield pipe 503 where coil bobbin 504 and electrostatic shield pipe 503 contact one another by disposing projections 508*a* and 508*b* at the open ends of the hollow part of coil bobbin 504. As a result, the shield heat generated by a coil 505 wrapped around coil bobbin 504 is hard to be transmitted to electrostatic shield pipe 503. Thus, this makes it possible to reduce a heat-stimulated electrical current flows between bushings (502*a* and 502*b*) and electrostatic shield pipe 503, when joule heat is transferred to these bushings 502*a* and 502*b* of a conventional reed relay and, therefore, the offset current that flows between relay ends 517*a* and 517*b* and the respective bushings 502*a* and 502*b* is reduced. Nevertheless, there is a demand for reed relays that have an even further reduced heat-stimulated electrical current as a result of the developments being made in measurement technology.

On the other hand, FIG. 3 in JP Laid-Open (Kokai) Patent Sho 59[1984]-71,227, FIG. 3, cites a reed relay with an electrostatic shield pipe that does not have bushings. This is shown in FIG. 8 as reed relay 700. That is, a contact part 3 with a reed piece 1 passes through a guard pipe 21 and both ends of this reed piece 1 are supported by studs 9. Here, the effect of heat-stimulated electrical current on the bushing is not taken into consideration. Nevertheless, in order to maintain insulation performance, contact part 3 with the reed piece must not touch guard pipe 21. Therefore, it is necessary to very carefully and precisely adjust the height of the studs when mounting this reed relay 700, and this increases production cost. Consequently, there is a need for technology that simplifies the mounting of reed relay 700.

As noted with regard to FIG. 6 in JP Laid-Open (Kokai) Patent Hei 8[1996]-279,314, FIG. 6. the insulation member (bushing) that supports a reed switch 34 inside a cylindrical conductor 37 is placed between conductors of different potentials; therefore, it is a known fact that a long settling time is needed prior to measurement because of the effect of dielectric absorption.

A problem which the present invention is intended to solve is to provide an inexpensive reed relay for microsignals that does not have bushings supporting the reed in order to avoid the above-mentioned problems caused by bushings mechanically supporting the reed of a reed relay, and an inexpensive mounting method therefor.

Another problem which the present invention is intended to solve is to provide a reed relay for microsignals having a mechanism for which the bushings no longer support the reed once the relay body is anchored whereby initially bushings that support the reed of a reed switch are temporarily anchored to an electrostatic shield pipe or coil bobbin during reed relay production and then the reed relay is mounted on a substrate, and further, the reed is anchored to the substrate, with or without studs, and the like, as well as a mounting method therefor and a bushing thereof.

Therefore, the object of the present invention is to provide a reed relay for microsignals, a mounting method, and a bushing that are capable of solving the above-mentioned problems. This object is accomplished by the combination of characteristics according to the independent claims. The subordinate claims give other preferred embodiments of the present invention.

SUMMARY OF THE INVENTION

One embodiment according to the present invention includes a reed relay comprising: a reed switch with reeds at both ends; an electrostatic shield pipe inside which the reed switch passes; a coil bobbin having a hollow part wherein the electrostatic shield pipe is disposed; and a removable bushing attached to the electrostatic shield pipe or the coil bobbin and having a reed support hole for supporting the reed switch.

The removable bushing preferably comprises a slot disposed in the bushing extending from the outside periphery of the bushing to the reed support hole. Moreover, the removable bushing comprises a handle that pulls the bushing toward the outside in the lengthwise direction of the electrostatic shield pipe.

The electrostatic shield pipe comprises a slot disposed toward the inside in the lengthwise direction at both open ends of the electrostatic shield pipe. The electrostatic shield pipe comprises a partial slot cutting open virtually the top half of both open ends of the electrostatic shield pipe to the width of the bushing.

The removable bushing is formed from a heat-shrinkable or infrared ray-shrinkable member.

Another embodiment according to the present invention includes a reed relay comprising: a reed switch with reeds at both ends; an electrostatic shield that virtually covers the outside periphery of the reed switch; a coil bobbin having a hollow part wherein the electrostatic shield pipe is disposed; and a removable bushing attached to the coil bobbin and having a reed support hole for supporting the reed switch.

Still yet another embodiment of the present invention includes a reed relay, comprising: a reed switch with reeds at both ends; an electrostatic shield pipe inside which the reed switch passes; and a bushing having a reed support hole for supporting this reed switch and that is temporarily anchored to this electrostatic shield pipe and can be removed from inside the electrostatic shield pipe.

Another embodiment involves a removable bushing in the shape of a plate that is attached to the electrostatic shield pipe or coil bobbin of a reed relay and supports a relay switch inside the electrostatic shield pipe or the hollow part of a coil bobbin, the removable bushing comprising: support holes that support the reed switch; and a slot that extends from the outside periphery of the bushing to the support hole. According to this embodiment the removable bushing is in the shape of a disk and the removable bushing comprises a handle for removal. The removable bushing comprises a stopper to keep it from moving further inside the electrostatic shield pipe. Optionally, the removable bushing comprises flanges for engaging with the outside at the ends of the electrostatic shield pipe.

Furthermore, the present invention also includes a method for mounting a reed relay comprising a reed switch with reeds at both ends, an electrostatic shield pipe inside which the reed switch passes, a coil bobbin having a hollow part wherein the electrostatic shield pipe is disposed, and bushings attached to the electrostatic shield pipe or coil bobbin and having a reed support hole for supporting the reed switch, the method for mounting a reed relay comprising: anchoring the reed relay and reeds at both ends to a substrate or studs disposed on the substrate; and disabling the mode of operation of the bushing that supports the reed switch. The step for disabling comprises a step for detaching the bushing from the reed through a slot that has been pre-disposed in this bushing. The step for disabling comprises a step for irradiating the bushing formed from a heat-shrinkable member or an infrared ray-shrinkable member with heat or infrared rays.

Another embodiment is a method for mounting a reed relay comprising a reed switch with reeds at both ends, an electrostatic shield that virtually covers the outside periphery of this reed switch, a coil bobbin having a hollow part wherein the electrostatic shield pipe is disposed, and bushings attached to the electrostatic shield pipe or coil bobbin and having a reed support hole for supporting the reed switch, the method for mounting a reed relay comprising: anchoring the reed relay and reeds at both ends to a substrate or studs disposed on the substrate; and disabling the mode of operation of the bushing supporting the reed switch. The step for disabling comprises detaching the bushing from the reed through a slot that has been pre-disposed in the bushing. The step for disabling comprises irradiating the bushing formed from a heat-shrinkable member or an infrared ray-shrinkable member with heat or infrared rays.

BRIEF DESCRIPTION OF THE DRAWINGS

FIG. 9 is a schematic drawing showing the third working example of the present invention.

DETAILED DESCRIPTION OF THE PREFERRED EMBODIMENT

Figure 1:
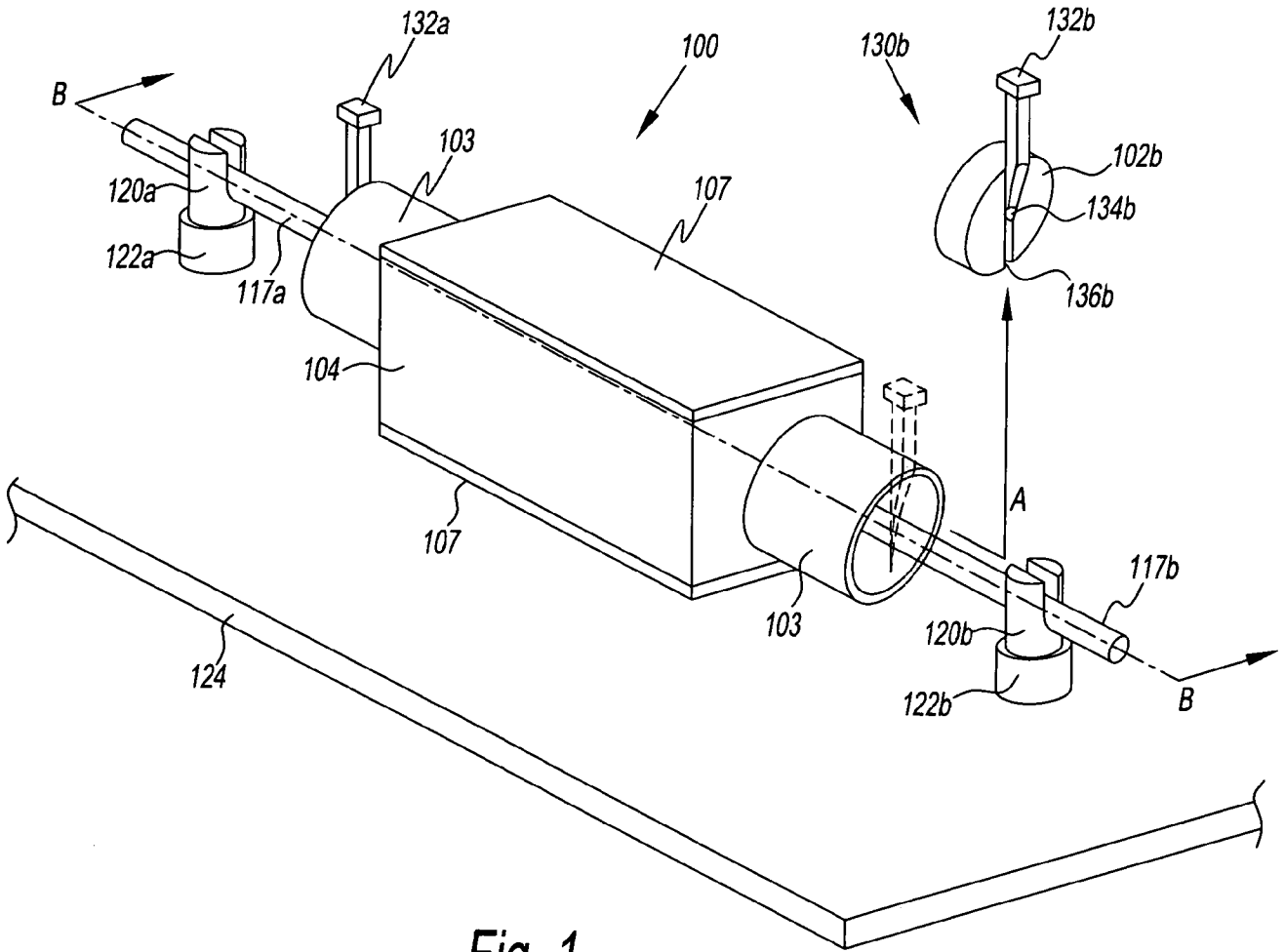
FIG. 1 is an oblique view showing the structure of the reed relay of the first working example of the present invention.
Figure 2:
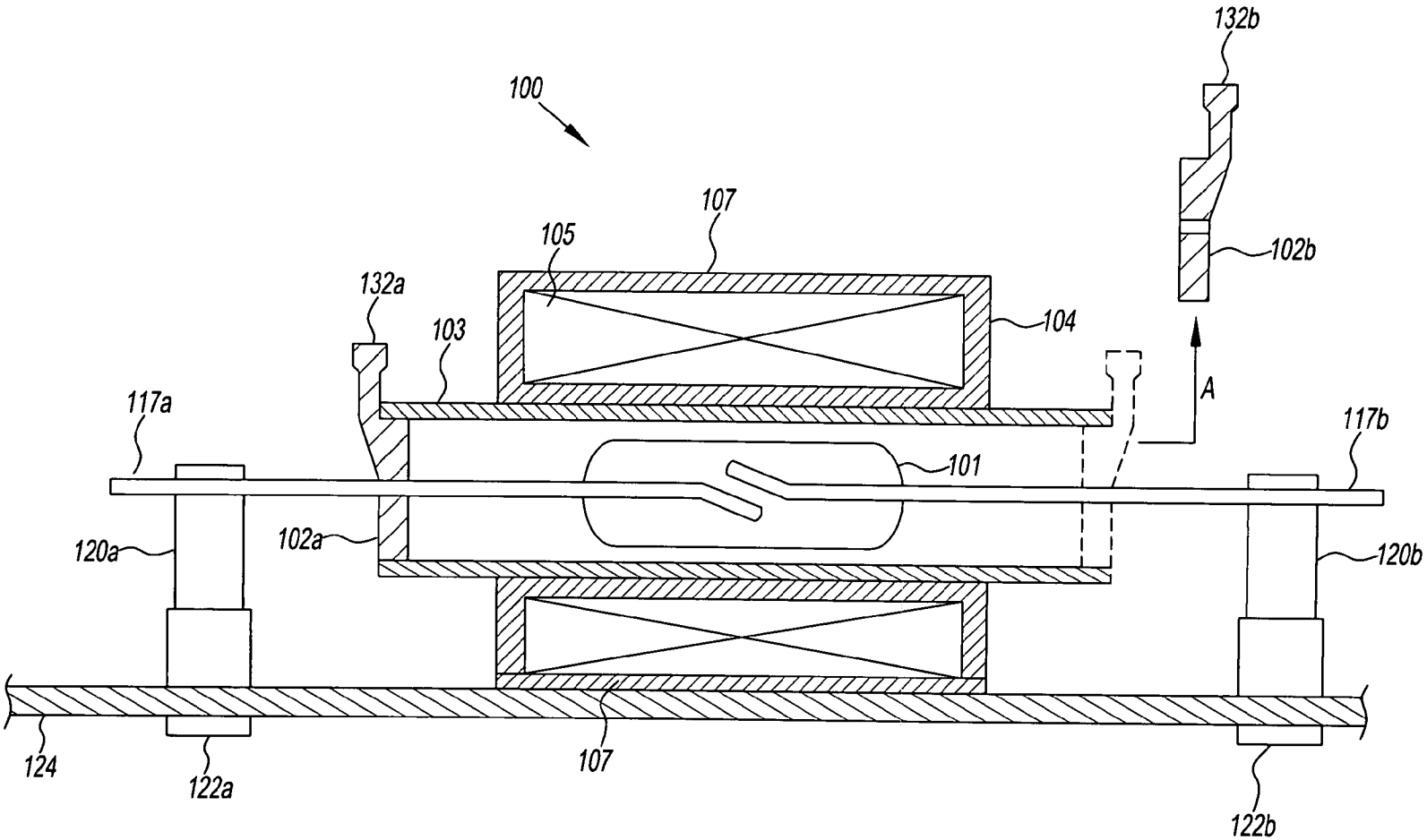
FIG. 2 is a cross section showing the B-B cross section in FIG. 1.
Figure 4:
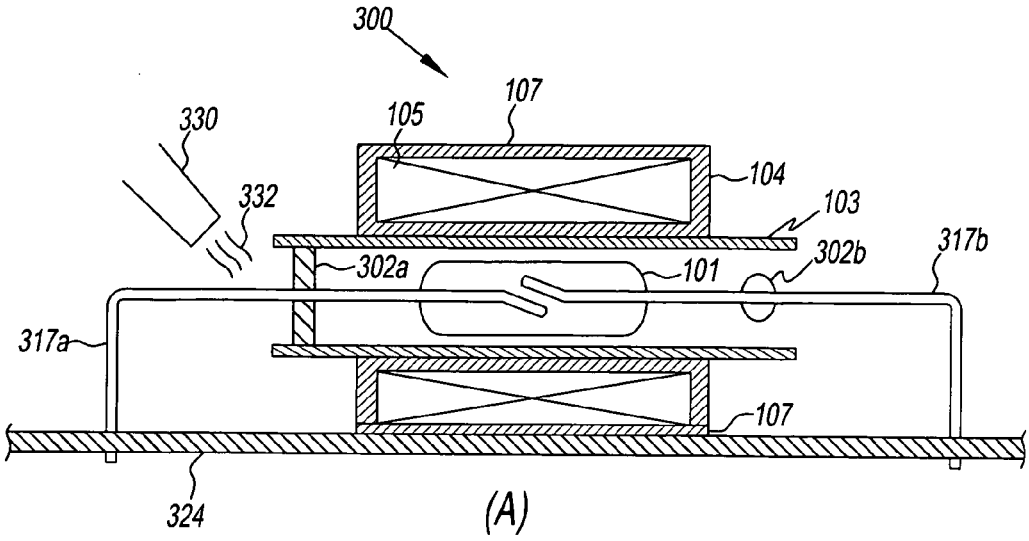
FIG. 4 is a cross section showing the fifth working example of the present invention.
Figure 4:
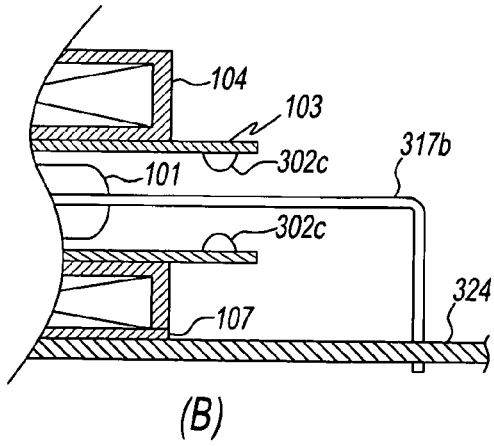

FIG. 1 shows an oblique view of a reed relay 100, the first working example of the present invention, and FIG. 2 shows the B-B cross section thereof. Here, a reed switch 101 is a switch piece sealed in a glass vessel and reeds 117*a* and 117*b* extend to either end of the reed switch. Reed relay 100 is first anchored on a substrate 124 with reed switch 101 and reeds 117*a* and 117*b* at either end supported inside an electrostatic shield pipe 103 by removable bushings 102*a* and 102*b*. A soldered coil bobbin 104 or a shield case 107 thereof, or another conventional means is used as the anchoring means. Two reeds 117*a* and 117*b* are also anchored to the substrate by a conventional method. FIGS. 1 and 2 show an example wherein two reeds 117*a* and 117*b* are anchored by studs 120*a* and 120*b* using Teflon® or another insulating material as the base. The bases using Teflon® or another insulating material are shown as 122*a* and 122*b*. Moreover, the reeds can be bent and soldered to substrate 124 without using Teflon® studs, as in another example in FIG. 4.

Once reed relay 100 has been anchored to substrate 124, bushings 102*a* and 102*b* are removed as described next. Bushings 102*a* and 102*b* comprise a body 102*a*, 102*b* in the shape of a disk, a support hole 134*b* for supporting the reeds in the center of this disk, a slot 136*b* that extends from the outside periphery to support hole 134*b*, and a handle 132*b* that is used when the bushing is detached, as shown separately by 130*b* in FIG. 1.

The bushings are initially attached to the open ends of electrostatic shield pipe 103 and only handle 132*a* projects outside electrostatic shield pipe 103, as shown by 102*a* in FIGS. 1 and 2. Next, handle 132*b* is pulled toward the outside in the lengthwise direction of reed relay 100, as shown by hook-shaped arrow A at the open end on the right side of electrostatic shield pipe 103 in FIGS. 1 and 2, and bushing 102*b* is pulled out of electrostatic shield pipe 103. Then bushing 103*b* is pulled up through slot 136*b* and detached from the reed. In this case, bushings 102*a* and 102*b* can be an insulating member of a conducting member, but it is preferred that they are members that are somewhat flexible or can be easily deformed so that they can be detached from reed 117*b*.

The bushing handle shown here is an arm extending up with a knob at the tip, but it can have any shape as long as it is one that facilitates detaching the bushings, and any of these shapes are included in the present invention. For instance, there can be multiple handles. Moreover, the length of the handle projecting from the electrostatic shield pipe can be the minimum length necessary. Furthermore, the handle can project not only in the direction of the electrostatic shield pipe cross section, as shown in FIG. 1, but also toward the outside in the lengthwise direction of the electrostatic shield.

By means of the above-mentioned structure, the reed relay is easily handled when being attached to a substrate, and once it is attached, the bushing can be easily removed; therefore, an inexpensive, high-performance reed relay is provided with which there is a reduction in the generation of offset voltage due to the generation of heat-stimulated electrical current by heat transmitted through the bushing and there is also a reduction in the effect of dielectric absorption on settling time from conductors with different potentials nearby.

Figure 3:
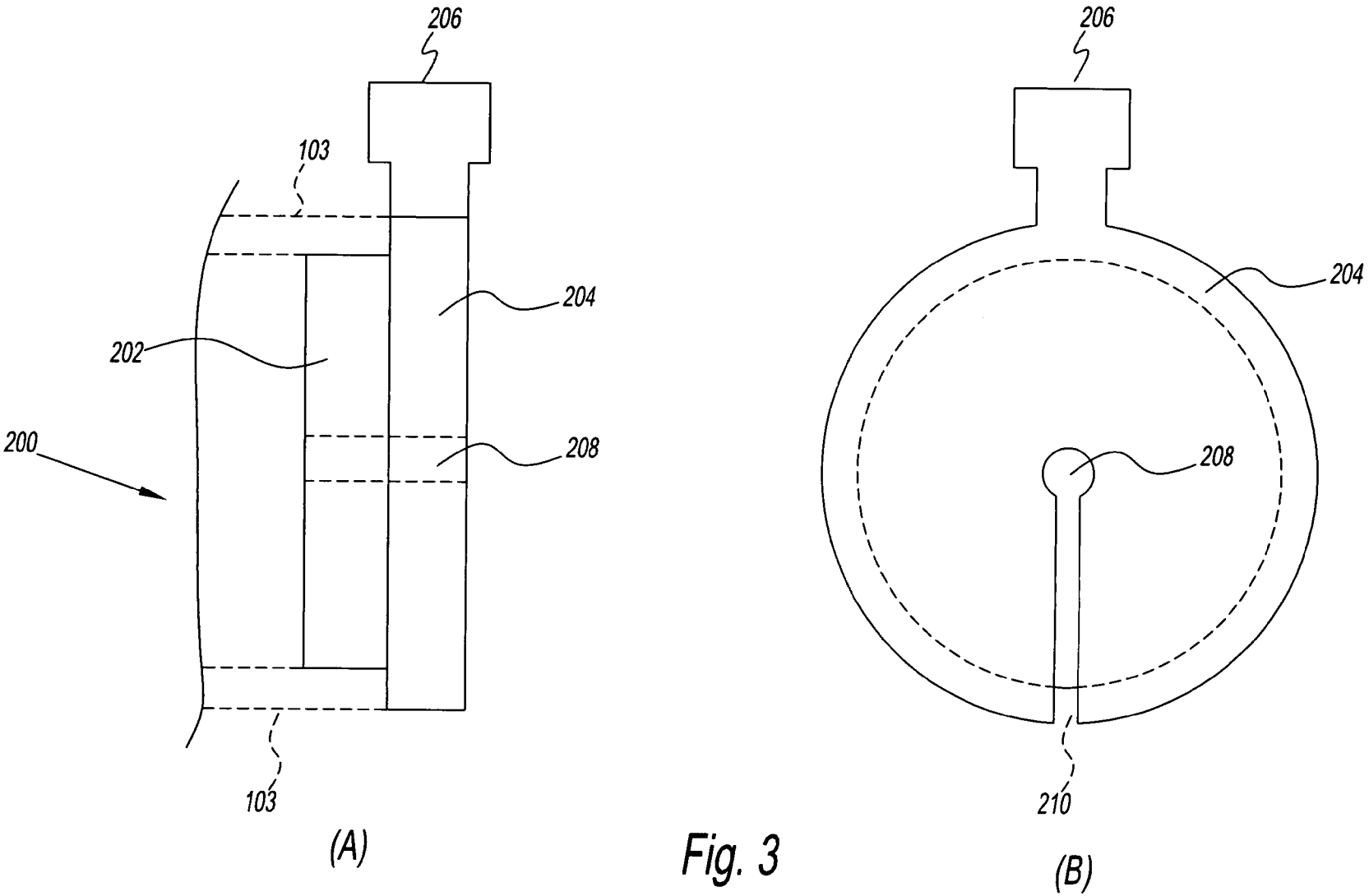
FIG. 3 is a schematic drawing of the second working example of the present invention.

Another removable bushing 200 is shown in FIG. 3 as a second working example. This comprises a body part 202 inside electrostatic shield pipe 103; a stopper 204 that does not enter electrostatic shield pipe 103; a handle 206 that projects to the top of stopper 204; a support hole 208 for the reed; and a slot 210 extending to the support hole. The rest of the structure of the reed relay and the method of using the bushing are omitted because they are the same as in FIGS. 1 and 2.

By means of this structure, it is possible to prevent the removable bushing from slipping into the electrostatic shield pipe where it cannot be retrieved.

Yet another removable bushing 220 is shown in FIG. 9 as a third example. This comprises annular flange 224 for engaging the bushing with the outside periphery at the open ends of electrostatic shield pipe 103. As a result, the bushing is attached to the outside of electrostatic shield pipe 103 and supports the reed. A bushing body 222 comprises a support hole 226 for the reed and a slot 228 extending from the outside periphery to the support hole, as in the above-mentioned working examples. The rest of the structure of the reed relay and the method of using the bushing are the same as in FIGS. 1 and 2 and are therefore omitted.

By means of this type of structure, it is possible to prevent the removable bushing from slipping into the electrostatic shield pipe where it cannot be retrieved.

Figure 10:
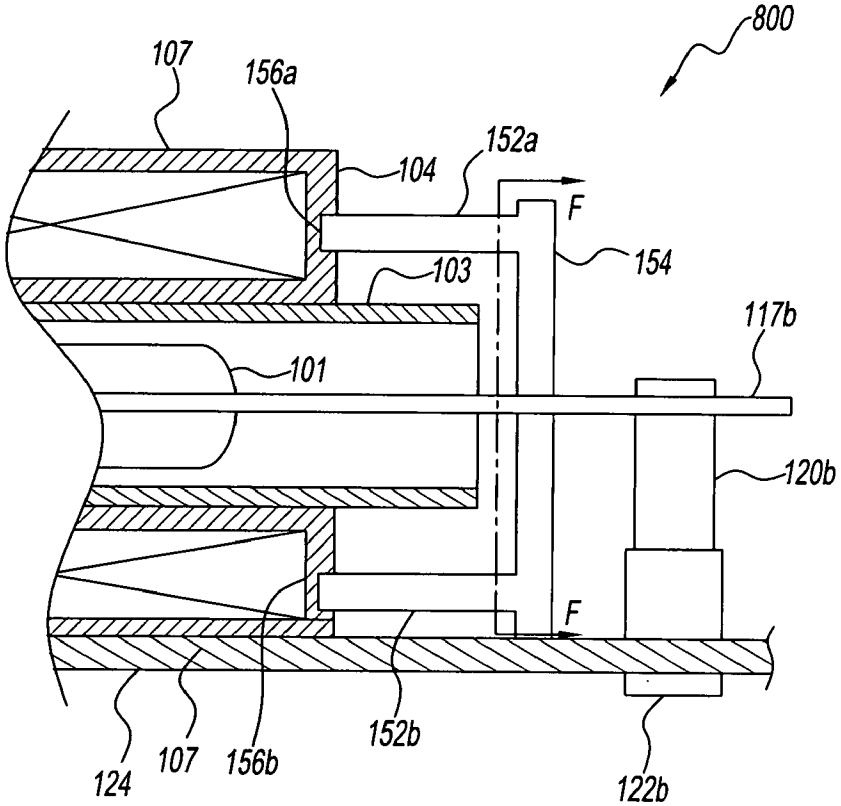
FIG. 10 is a schematic drawing showing the fourth working example of the present invention.
Figure 10:
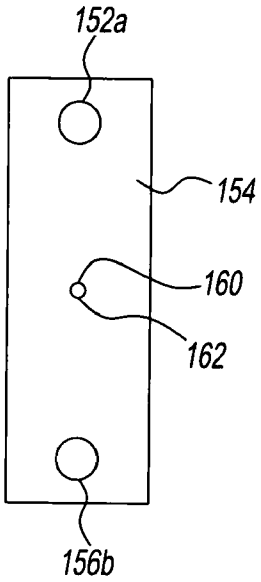

Reed relay 800 that uses yet another removable bushing 154 is shown in FIG. 10(A) as the fourth working example, and the F-F cross section thereof is shown in FIG. 10(B). Bushing 154 has two legs 152*a* and 152*b*. The tips of these two legs are inserted into holes 156*a* and 156*b* made in the coil bobbin so that the bushing supports reed 117*b* outside electrostatic shield pipe 103. As shown in FIG. 10(B), bushing 154 has a reed support hole 160 and a slot 162 that extends from the outside periphery to the support hole. It is not necessarily disk-shaped, but it is preferably disk shaped.

A modified version of the fourth working example has the ends of shield case 107 extending up and down with the bushing supporting the reed fastened between these ends.

In addition, the present invention is not limited to the case where the bushing is simply removed from the shield pipe; the object of the present invention can also be accomplished by eliminating, that is, deactivating, the mode of operation wherein the reed and electromagnetic shield pipe are mechanically supported by the bushing.

A cross section of reed relay 300, a fifth working example of the present invention, is shown in FIG. 4(A). This shows an example where both ends 317*a* and 317*b* of the reed are bent and soldered to a substrate 324. However, they can also be anchored to studs as in FIG. 1.

By means of reed relay 300, a bushing 302*a* is in the shape of a disk, as shown by 302*a* before it has been removed, and it supports a reed 317*a* inside electrostatic shield pipe 103. Bushing 302*a* is formed from a heat-shrinkable or an infrared ray-shrinkable member. Once reed relay 300 has been anchored to substrate 324, it is shrunk by a heat source 330, such as a dryer, or by radiation 332 from an infrared ray source, as shown by 302*b* at the right opening in electrostatic shield pipe 103. Even if part of the bushing remains on the inside wall of electrostatic shield pipe 103 in this case, the space between electrostatic shield pipe 103 and reed 317*b* is divided. In other words, bushing 302*b* has lost the mode of operation of mechanically supporting the reed inside the electrostatic shield pipe. As a result, a heat-stimulated electrical current will not flow through bushing 302*b*. Moreover, even if the bushing is made from an insulating dielectric, in this state it is not connected between two conductors of different potentials and there is no chance that there will be an effect due to dielectric absorption.

Bushing 302*b* of FIG. 4(A) is shown shrunk toward the middle of the disk that forms the bushing, but the case wherein the bushing is shrunk so that it is pulled toward the outside periphery of the disk as shown by bushing 302*c* in FIG. 4(B) is given in accordance with how the heat or infrared rays radiate. Bushing 302*b* in FIG. 4(A) is the expected result when heat or infrared rays are emitted over the entire bushing or when heat or infrared rays are emitted around electrostatic shield pipe 103, while bushing 302*c* in FIG. 4(B) is the expected result when heat or infrared rays are emitted around reed 317*b*.

Polyvinyl chloride, silicone, expandable polystyrene, and the like that are used for heat-shrinkable tubes, such as Hishi Tube made by Mitsubishi Plastics, Inc., can be used as the heat or infrared ray-shrinkable material.

Figure 5:
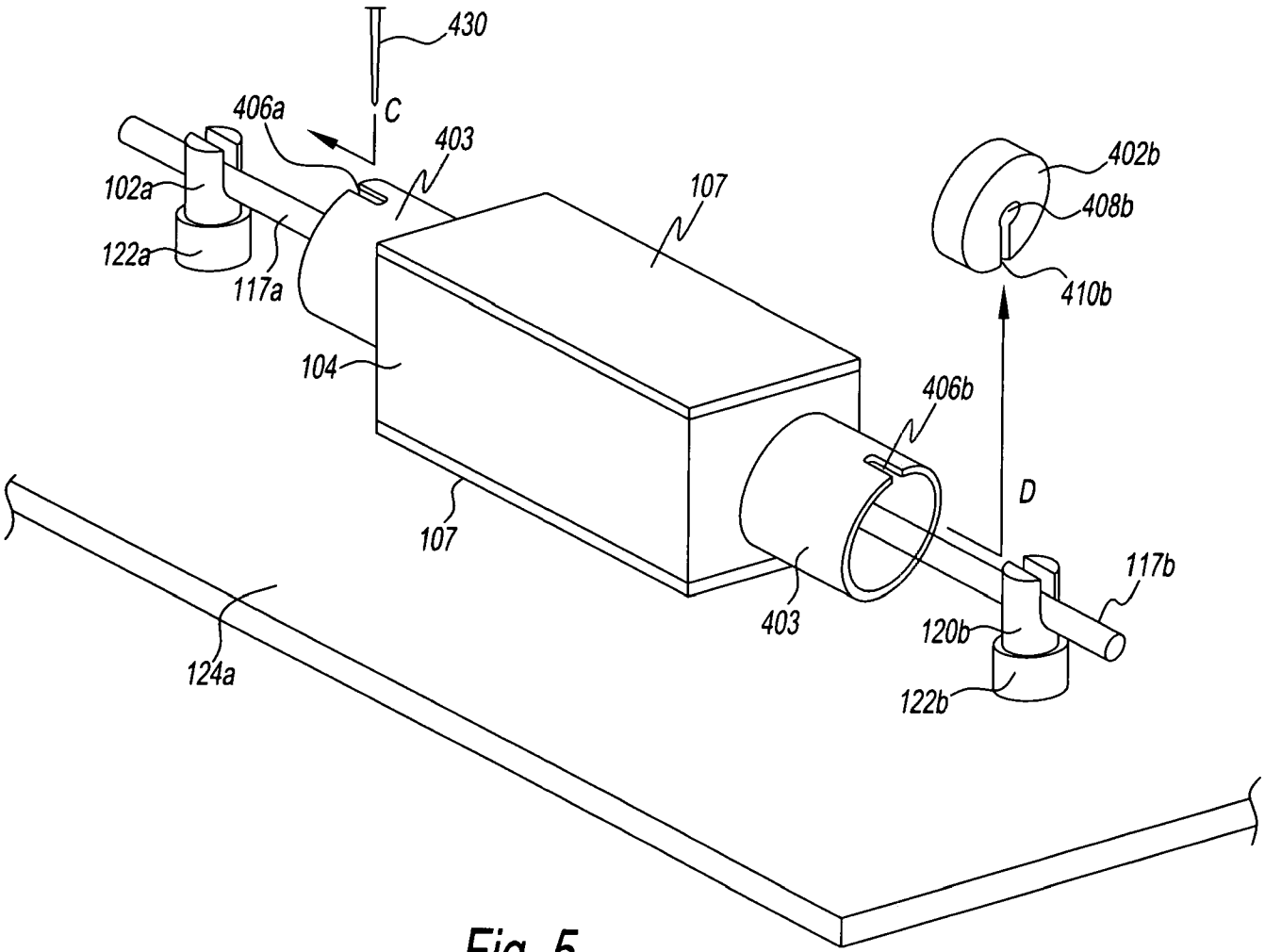
FIG. 5 is an oblique view showing the sixth working example of the present invention.

An oblique view of reed relay 400 is shown in FIG. 5 as a sixth working example. Here, the bushing 402*b* has support hole 408*b* for the reed and slot 410*b* that extends from the outside periphery to the support hole, as shown by 402*b*. Moreover, an electrostatic shield pipe 403 has slots 406*a* and 406*b* that extend from the open ends. The length of these slots varies, but the case where they are somewhat longer than the thickness of bushing 402*b* will be described as one embodiment. Once reed relay 400 has been anchored to substrate 124*a*, a needle 430, or similar object is inserted into slot 406*a* and pushes on the bushing from the back, as shown by arrow C, when the bushing is inside the electrostatic shield pipe. It is also possible to push the bushings, of which a portion is appeared, from slots 406*a* and 406*b* with needle 430 toward the outside in the lengthwise direction of the electrostatic shield pipe. When this is done, it is possible to detach bushing 402*b* from electrostatic shield pipe 403 and reeds 117*a* and 117*b*, as shown by arrow D.

If there is concern over deterioration of noise resistance due to slots 406*a* and 406*b* after the bushing has been detached, the slots can be sealed by soldering in order to prevent such deterioration of noise resistance.

Figure 6:
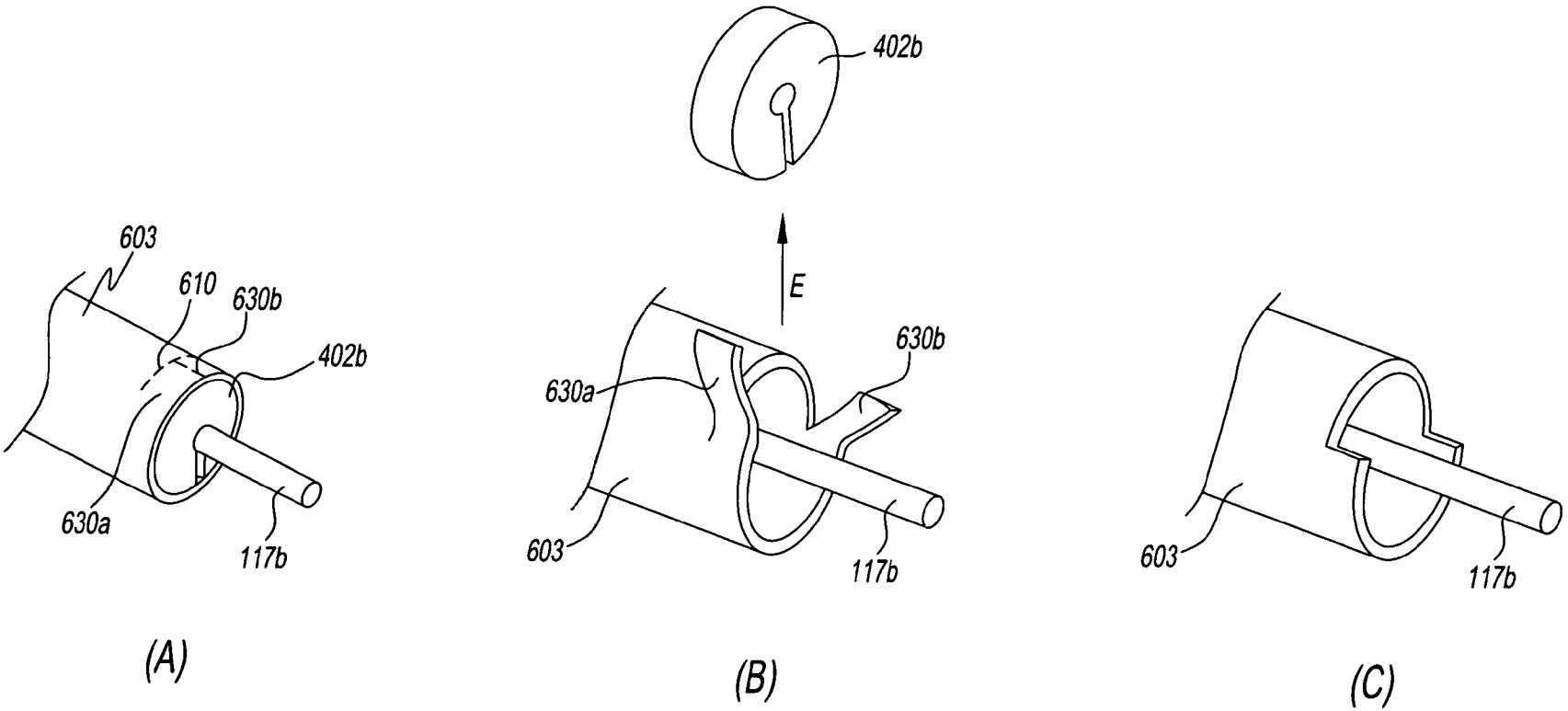
FIG. 6 is a schematic drawing showing the seventh working example of the present invention.
Figure 7:
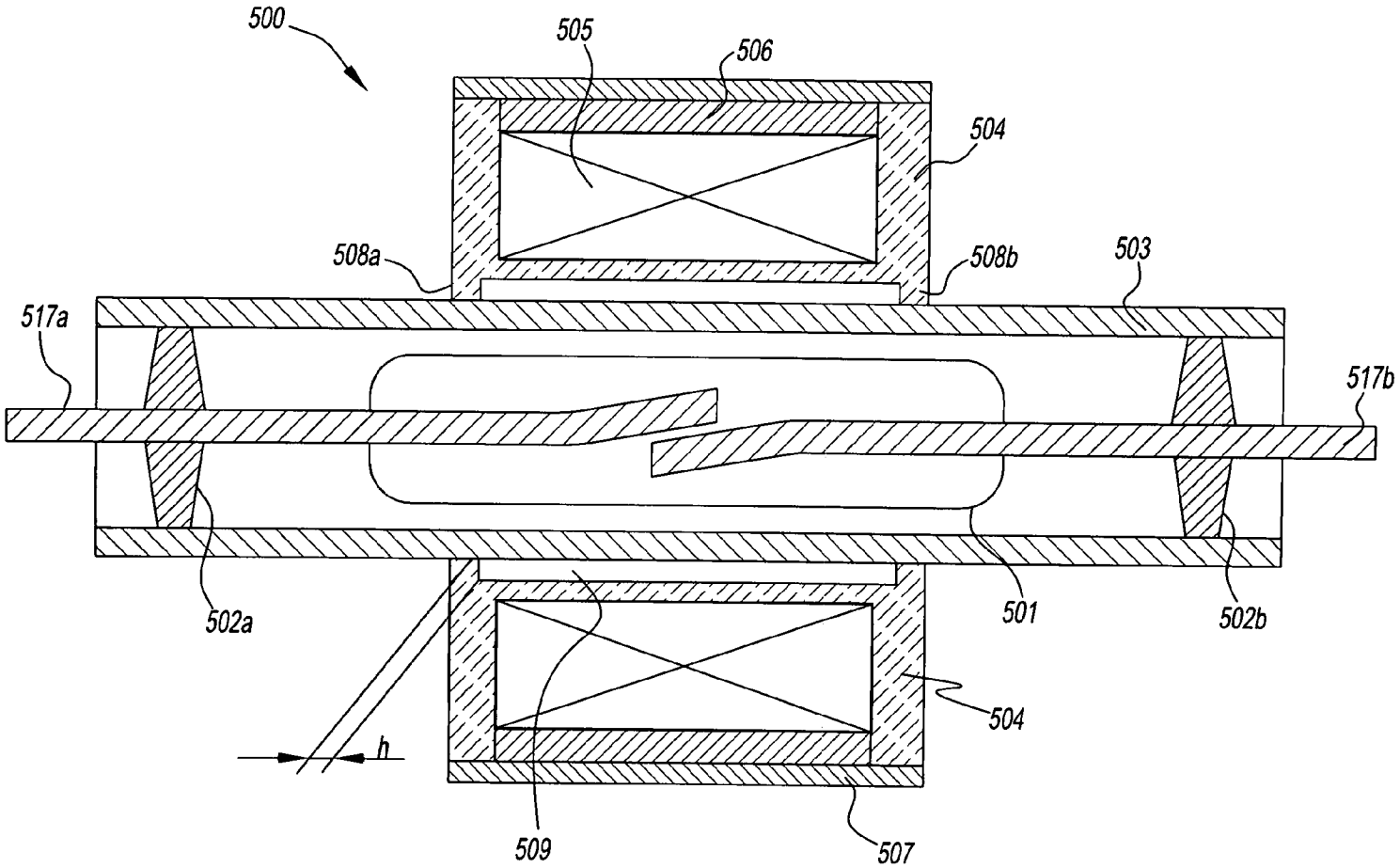
Fig. 7 (Prior Art)
FIG. 7 is a cross section showing the structure of a conventional reed relay.
Figure 8:
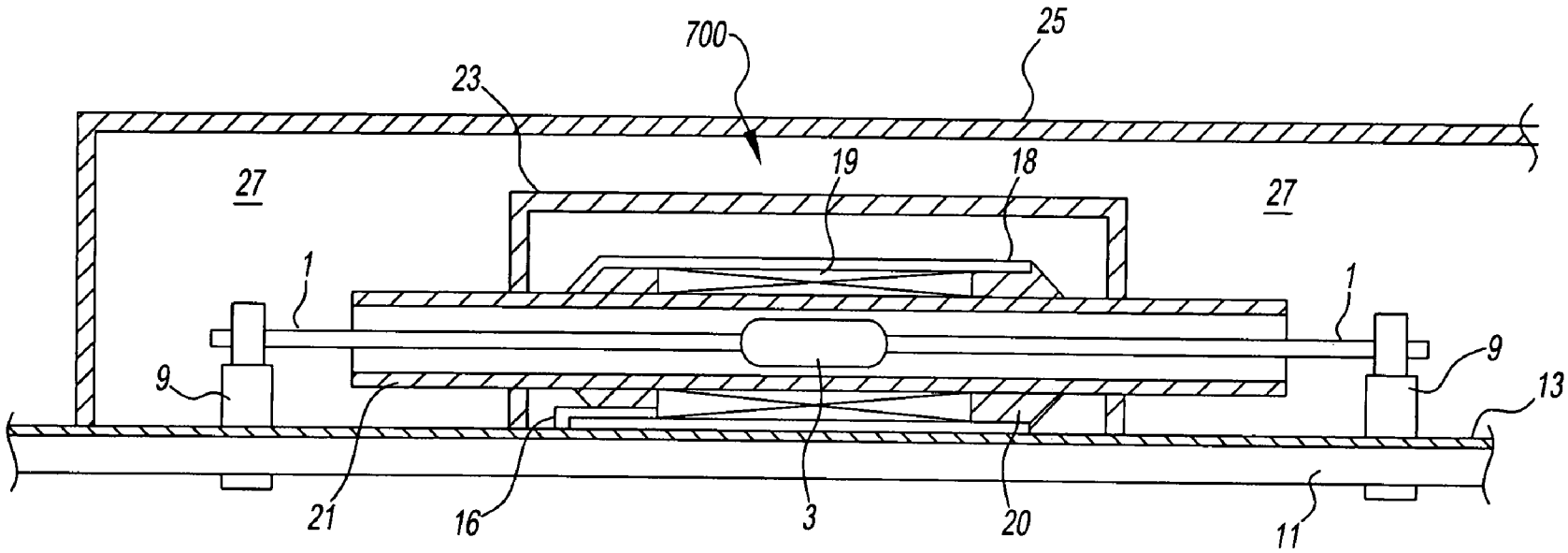
Fig. 8 (Prior Art)
FIG. 8 is a cross section showing the structure of another conventional reed relay.

An electrostatic shield pipe 603 used in the reed relay is shown in FIGS. 6(A) through (C) as a seventh working example of the present invention. The bushing used in this example is the same as shown in FIG. 5 and is bushing 402*b*. As shown in FIG. 6(A), a T-shaped scored slot or a T-shaped perforated slot 610 is made in the top half of the open ends of an electrostatic shield pipe 603 to facilitate cutting. Next, as shown in FIG. 6(B), an incision is made along this T-shaped slot 610 and the open ends of the electrostatic shield pipe are opened as two tongues 630*a* and 630*b*. Bushing 402*b* is pulled in the direction of arrow E. Both the cutting open along T-shaped slot 610 and the pulling out of bushing 402*b* are performed from above and the operations are therefore both simplified, even if they are performed after the reed relay has been anchored to the substrate. The width of tongues 630*a* and 630*b* should be somewhat greater than the width of the bushing to facilitate detachment. Once the bushing has been removed, the two tongues can be removed as in FIG. 6(C), or tongues 630*a* and 630*b* can be soldered back to their original state in FIG. 6(A).

It should be noted that above-mentioned working examples were described assuming that the electrostatic shield pipe is a pipe, but it goes without saying that a guard made by applying conductive paint to the inside walls of the hollow part of a coil bobbin, and similar structures will have the same effect and these are included in the present invention. Moreover, the electrostatic shield pipe does not necessarily project from the coil bobbin and, depending on the extent of the effect, a variety of modifications to the present invention are possible, such as cutting the end of the electrostatic shield pipe on the same side as the coil bobbin surface.

Figure 11:
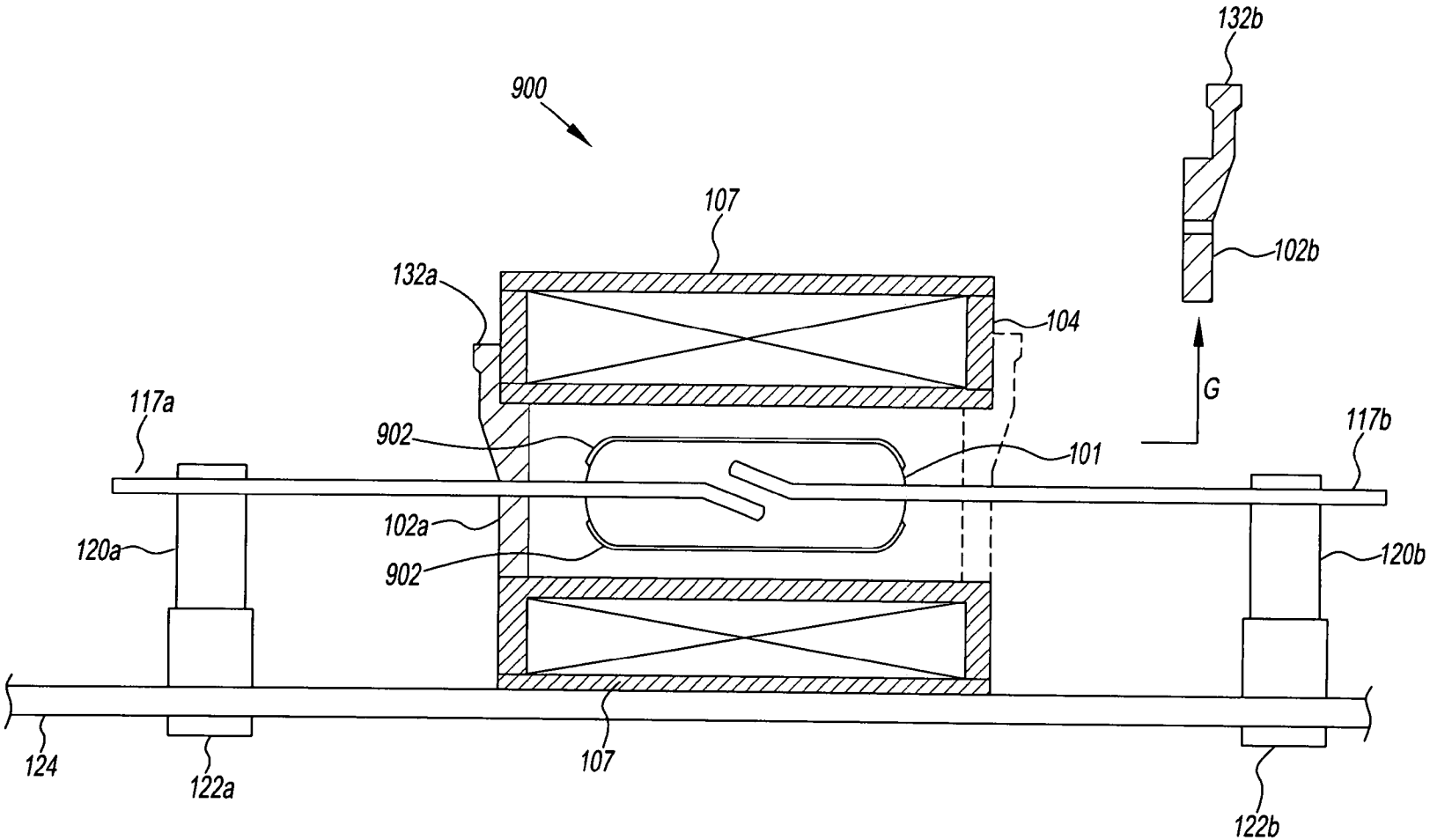
FIG. 11 is a cross section showing the eighth working example of the present invention.

Reed relay 900 that does not use an electrostatic shield pipe but has the same effect is shown in FIG. 11 as the eighth working example. By means of this example, virtually the entire outer periphery of a glass vessel inside which reed switch 101 is sealed is covered by an electrostatic shield 902 using a conductive film such that it does not contact reeds 117*a* and 117*b*. Reed switch 101 having electrostatic shield 902 is supported in the hollow part of coil bobbin 104 by bushings 132*a* and 132*b* described as 130*b* in FIG. 1, which were attached to the hollow part of coil bobbin 104. Reed relay 900 is anchored to substrate 124 and reeds 117*a* and 117*b* are anchored to studs 120*a* and 120*b*. Handles 132*a* and 132*b* of bushings 102*a* and 102*b* are pulled in an L-shape as shown by arrows G to detach the bushings from reeds 117*a* and 117*b* and complete the mounting of reed relay 900.

It should be noted that bushing 200 in FIG. 3 can be used in place of bushings 102*a* and 102*b* in the eighth working example. Moreover, electrostatic shield 902 can be formed by applying a conductive paint to the surface of the glass vessel inside which the reed switch is sealed, or by wrapping metal wire around the surface of the vessel.

Moreover, electrostatic shield pipes 103, 403, and 603 or electrostatic shield 902 in each of the working examples described above is connected to guard potential by a connection line that is not illustrated. It is preferred that the guard potential here is the potential from an active guard.

By means of the present invention, the reed switch is reliably supported inside an electrostatic shield pipe or inside the hollow part of a coil bobbin by bushings on the inside or the outside of the electrostatic shield pipe, or attached to the coil bobbin. Therefore, the reed relay comprising this reed switch can be easily anchored to a substrate while maintaining the positional relationship between the relay and the switch. Moreover, once the reed relay and both reeds have been attached to substrates or studs or other parts attached to the substrate, the bushing can be detached or shrunk so that it no longer supports the reeds in the electrostatic shield pipe and there is therefore, no path through which heat can be transmitted from the electrostatic shield pipe or coil bobbin to the switch; as a result, the structure is one with which there is very little effect from heat-stimulated electric current or dielectric absorption. Consequently, there is an advantage in that the offset current and the settling time of the reed relay for microsignals are very small.

Working examples based on the present invention have been described. However, persons skilled in the art are quick to understand that various alterations and modifications can be implemented based on the concept of the present invention. For instance, a reed relay that is hardly affected by heat can be made by using various types of coil bobbins that reduce the heat conduction according to JP Laid-Open (Kokai) Patent 2001-14,994, FIG. 5, as the coil bobbin used in each of the working examples. Moreover, the present invention can be used not only for reed relays where one reed switch is housed in a vessel, but also for reed relays where two or more reed switches are housed in this vessel. Moreover, the present invention can be used for reed relays wherein there are multiple reed switches housed in a vessel, whether the switching operation is one wherein all of the reed switches make or break simultaneously or one wherein some of the switches make, while the remainder of the switches break.

What is claimed is:

1. A reed relay comprising:

a reed switch with reeds at both ends;

an electrostatic shield pipe inside which the reed switch passes;

a coil bobbin having a hollow part wherein the electrostatic shield pipe is disposed; and a removable bushing attached to the electrostatic shield pipe or the coil bobbin and having a reed support hole for supporting the reed switch, wherein said removable bushing comprises a slot disposed in the bushing extending from the outside periphery of the bushing to the reed support hole.

2. The reed relay according to claim 1, wherein said removable bushing comprises a handle that pulls the bushing toward the outside in the lengthwise direction of the electrostatic shield pipe.

3. The reed relay according to claim 1, wherein said electrostatic shield pipe comprises a slot disposed toward the inside in the lengthwise direction at both open ends of the electrostatic shield pipe.

4. The reed relay according to claim 1, wherein said electrostatic shield pipe comprises a partial slot cutting open virtually the top half of both open ends of the electrostatic shield pipe to the width of said bushing.

5. A reed relay comprising:

a reed switch with reeds at both ends;

an electrostatic shield pipe inside which the reed switch passes;

a coil bobbin having a hollow part wherein the electrostatic shield pipe is disposed; and a removable bushing attached to the electrostatic shield pipe or the coil bobbin and having a reed support hole for supporting the reed switch, wherein the removable bushing is formed from a heat-shrinkable or infrared ray-shrinkable member.

6. A reed relay, comprising a reed switch with reeds at both ends;

an electrostatic shield pipe inside which the reed switch passes; and a bushing having a reed support hole for supporting this reed switch and that is temporarily anchored to this electrostatic shield pipe and can be removed from inside the electrostatic shield pipe, wherein said bushing has a slot extending from the outside periphery thereof to the reed support hole.

7. A removable bushing in the shape of a plate that is attached to the electrostatic shield pipe or coil bobbin of a reed relay and supports a relay switch inside the electrostatic shield pipe or the hollow part of a coil bobbin, said removable bushing comprising:

support holes that support the reed switch; and a slot that extends from the outside periphery of the bushing to the support hole.

8. The removable bushing according to claim 7, wherein said removable bushing is in the shape of a disk.

9. The removable bushing according to claim 7, wherein said removable bushing comprises a handle for removal.

10. The removable bushing according to claim 7, wherein said removable bushing comprises a stopper to keep it from moving further inside the electrostatic shield pipe.

11. The removable bushing according to claim 7, wherein said removable bushing comprises flanges for engaging with the outside at the ends of the electrostatic shield pipe.

12. A method for mounting a reed relay comprising a reed switch with reeds at both ends, an electrostatic shield pipe inside which the reed switch passes, a coil bobbin having a hollow part wherein the electrostatic shield pipe is disposed, and bushings attached to the electrostatic shield pipe or coil bobbin and having a reed support hole for supporting the reed switch, said method for mounting a reed relay comprising:

anchoring the reed relay and reeds at both ends to a substrate or studs disposed on the substrate; and disabling the mode of operation of the bushing that supports the reed switch.

13. The method for mounting according to claim 12, wherein the step for disabling comprises a step for detaching the bushing from the reed through a slot that has been pre-disposed in this bushing.

14. The method for mounting according to claim 12, wherein the step for disabling comprises a step for irradiating said bushing formed from a heat-shrinkable member or an infrared ray-shrinkable member with heat or infrared rays.

* * * * *